US010446074B2

(12) United States Patent
Chen et al.

(10) Patent No.: US 10,446,074 B2
(45) Date of Patent: Oct. 15, 2019

(54) DISPLAY PANEL AND DRIVE METHOD THEREOF

(71) Applicant: Innolux Corporation, Chu-Nan, Miao-Li County (TW)

(72) Inventors: Bo-Feng Chen, Chu-Nan (TW); Tsau-Hua Hsieh, Chu-Nan (TW)

(73) Assignee: INNOLUX CORPORATION, Chu-Nan, Miao-Li (TW)

( * ) Notice: Subject to any disclaimer, the term of this patent is extended or adjusted under 35 U.S.C. 154(b) by 340 days.

(21) Appl. No.: 15/361,237

(22) Filed: Nov. 25, 2016

(65) Prior Publication Data

US 2017/0154581 A1 Jun. 1, 2017

Related U.S. Application Data

(60) Provisional application No. 62/260,359, filed on Nov. 27, 2015.

(30) Foreign Application Priority Data

Jun. 8, 2016 (CN) ..... 2016 1 0405886

(51) Int. Cl.

| | |
|---|---|
| ***G09G 5/10*** | (2006.01) |
| ***G09G 3/32*** | (2016.01) |
| ***G09G 3/20*** | (2006.01) |

(52) U.S. Cl.

CPC ..... *G09G 3/32* (2013.01); *G09G 3/2018* (2013.01); *G09G 2310/08* (2013.01); *G09G 2330/10* (2013.01)

(58) Field of Classification Search

CPC ..... G09G 2310/08; G09G 2330/10; G09G 3/2018; G09G 3/32

See application file for complete search history.

(56) References Cited

U.S. PATENT DOCUMENTS 7,800,565 B2 9/2010 Nathan et al.
7,903,059 B2 3/2011 Chiou et al.

FOREIGN PATENT DOCUMENTS

CN 101271669 A 9/2008

OTHER PUBLICATIONS

Chinese Office Action dated Sep. 5, 2018.

*Primary Examiner* — Insa Sadio
(74) *Attorney, Agent, or Firm* — Rabin & Berdo, P.C.

(57) ABSTRACT

A display panel includes a plurality of gate lines, a plurality of source lines, a plurality of first transistors and a plurality of light emitting diodes. The control end of each of the first transistors receives a gate signal. The first end of each of the first transistors receives a source signal. The first end of each if the LEDs is electrically connected to the second end of one of the corresponding first transistors. The second end of each of the LEDs receives a drive signal. A frame time of the light emitting diodes includes a first cycle and a second cycle. Within the first cycle of the frame time, the level of the source signal is higher than the level of the drive signal. Within the second cycle of the frame time, the level of the source signal is lower than the level of the drive signal.

18 Claims, 4 Drawing Sheets

DISPLAY PANEL AND DRIVE METHOD THEREOF

This application claims the benefit of a provisional application Ser. No. 62/260,359, filed Nov. 27, 2015 and the benefit of People's Republic of China application Serial No. 201610405886.7, filed Jun. 8, 2016, the subject matters of which are incorporated herein by reference.

BACKGROUND

Field of the Disclosure

The disclosure relates in general to a display panel and a drive method thereof, and more particularly to a light emitting diode (LED) display panel and a drive method thereof.

Description of the Related Art

In recent years, many types of displays, such as thin-film transistor liquid crystal display (TFT-LCD) panels and active matrix organic light emitting diode (AMOLED) display panels, have been used in the display panels of portable electronic products, such as multi-media players, mobile phones, personal digital assistants (PDAs) and notebook computers. Of the flat panel displays, inorganic light emitting diode (LED) panels have higher yield rate, longer lifetime and higher resistance to current than organic light emitting diode (OLED) panels. During the manufacturing process of the light emitting diode (LED) panels, LED chips are bonded to a drive circuit substrate. Meanwhile, the anode end and the cathode end of the LED chip need to be electrically connected to the drive circuit correctly. That is, if the coupling direction of the LED chip is reversed, the anode end and the cathode end cannot be electrically connected to the drive circuit correctly. Under such circumstances, the LED may be damaged due to reverse bias or may not illuminate normally. Therefore, it has become a prominent task for the industries to provide a drive method capable of conducting LED under either coupling direction.

SUMMARY

According to one embodiment of the disclosure, a display panel is provided. The display panel includes a plurality of gate lines, a plurality of source lines, a plurality of first transistors and a plurality of light emitting diodes. The control end of each of the first transistors is electrically connected to one of the gate lines and receives a gate signal. The first end of each of the first transistors is electrically connected to one of the source lines and receives a source signal. The first end of each of the LEDs is electrically connected to the second end of one of the corresponding first transistors. The second end of each of the LEDs receives a drive signal. A frame time of the light emitting diodes includes at least a first cycle and a second cycle. Within the first cycle of the frame time, the level of the source signal is higher than the level of the drive signal. Within the second cycle of the frame time, the level of the source signal is lower than the level of the drive signal.

According to another embodiment of the disclosure, a drive method of a display panel is provided. The drive method of a display panel includes following steps. A gate signal is provided to a plurality of gate line. A source signal is provided to a plurality of source line. A drive signal is provided to a plurality of second ends of a plurality of LEDs. A frame time of the light emitting diodes comprises at least a first cycle and a second cycle. Within the first cycle of the frame time, the level of the source signal is higher than the level of the drive signal. Within the second cycle of the frame time, the level of the source signal is lower than the level of the drive signal.

Above and other aspects of the disclosure will become understood with regard to the following detailed description but non-limiting embodiment(s). The following description is made with reference to accompanying drawings.

DETAILED DESCRIPTION OF THE EMBODIMENT

Figure 1:
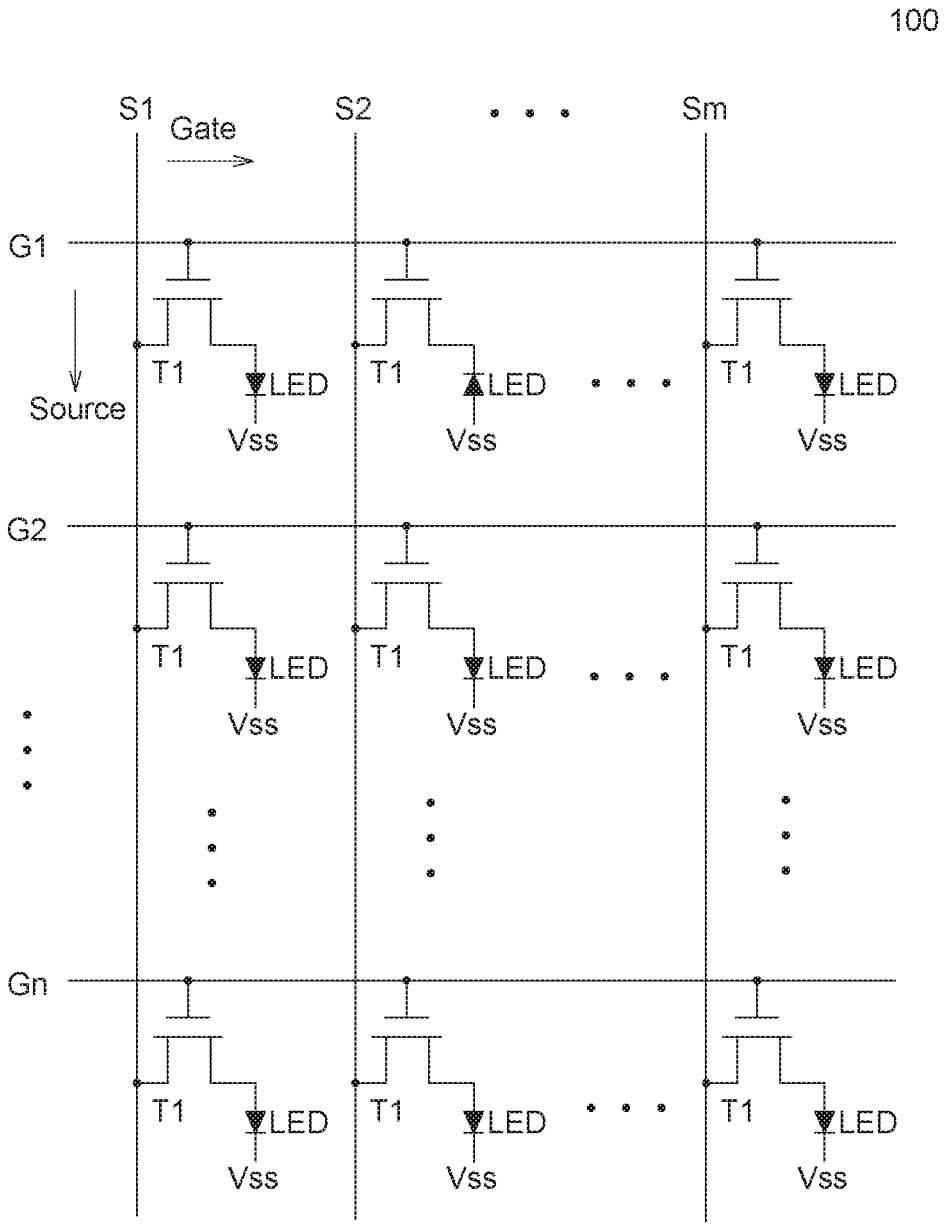
FIG. 1 is a circuit diagram of a display panel according to an embodiment of the present disclosure.

FIG. 1 is a circuit diagram of a display panel 100 according to an embodiment of the present disclosure. The display panel 100 includes a plurality of gate lines G1-Gn, a plurality of source lines S1-Sm, a plurality of first transistors T1 and a plurality of light emitting diodes LED. The control end of each first transistor T1 is electrically connected to one of the gate lines G1-Gn and receives a gate signal Gate. The first end of the first transistor T1 is electrically connected to one of the source lines S1-Sm and receives a source signal Source. The light emitting diodes are arranged as an array. The first end of each light emitting diode is electrically connected to the second end of one of the corresponding first transistors T1. The second end of each light emitting diode receives a drive signal Vss.

In a frame time of the light emitting diodes, the gate signal Gate is at an enabling level to turn on the corresponding first transistor T1, such that the first transistor T1 receives a source signal Source and provides the received source signal Source to the first end of a corresponding light emitting diode.

Figure 2A:
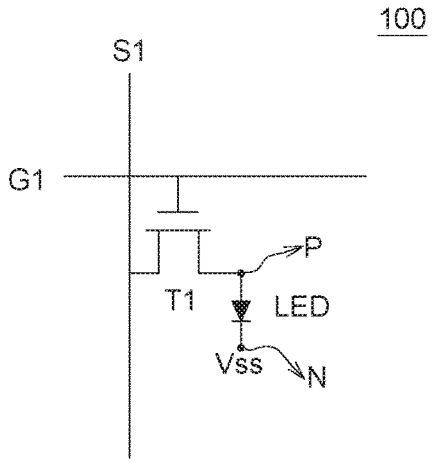
FIG. 2A and FIG. 2B are a circuit diagram of an example of the display panel of the present disclosure.
Figure 2B:
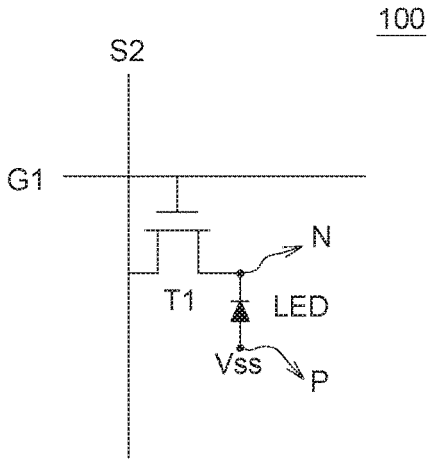

In the present disclosure, the coupling directions of the light emitting diodes are not subject to specific restrictions. The light emitting diodes include a first LED group and a second LED group. As indicated in FIG. 2A, the anode end P of the first LED group is electrically connected to the second end of the first transistor T1; the cathode end N of the first LED group receives a drive signal Vss. As indicated in FIG. 2B, the cathode end N of the first LED group is electrically connected to the second end of the first transistor T1; the anode end P of the first LED group receives a drive signal Vss. The drive signal Vss may be at a DC voltage level (voltage level remains unchanged), an AC voltage level, a DC current level (current level remains unchanged) or an AC current level. The AC voltage level may be formed by a DC voltage level plus a small magnitude of AC voltage signal. The AC current level may be formed by a DC current level plus a small magnitude of AC current signal.

In the present disclosure, a frame time may include a first cycle and a second cycle. In the first cycle, the level of the source signal is higher than the level of the drive signal. In the second cycle, the level of the source signal is lower than the level of the drive signal. Since the level of the source signal is higher than the level of the drive signal in the first cycle, the LED whose anode end P is electrically connected to the second end of the first transistor T1 (that is, the LED electrically connected according to the coupling direction of FIG. 2A) is turned on, and the LED whose cathode end N is electrically connected to the second end of the first transistor T1 (that is, the LED electrically connected according to the coupling direction of FIG. 2B) is not turned on. Since the level of the source signal is lower than the level of the drive signal in the second cycle, the LED whose anode end P is electrically connected to the second end of the first transistor T1 (that is, the LED electrically connected according to the coupling direction of FIG. 2A) is not turned on, and the LED whose cathode end N is electrically connected to the second end of the first transistor T1 (that is, the LED electrically connected according to the coupling direction of FIG. 2B) is turned on. Thus, the drive method of the present disclosure can conduct the LED electrically connected according to either one of the two coupling directions.

Figure 3A:
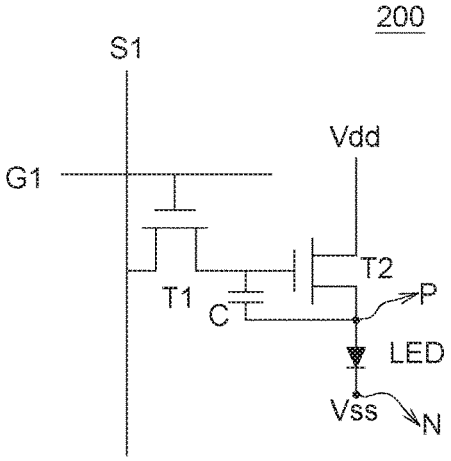
FIG. 3A and FIG. 3B are a circuit diagram of another example of the display panel of the present disclosure.
Figure 3B:
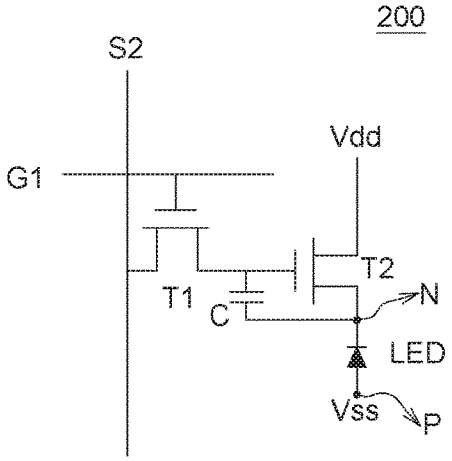

However, the present disclosure is not limited thereto. FIG. 3A and FIG. 3B respectively are a circuit diagram of another example of the display panel 200 of the present disclosure. The display panel 200 is different from the display panel 100 in that: the display panel 200 further includes a capacitor C and a second transistor T2. The capacitor C is electrically connected between the second end of a first transistor T1 and the first end of a light emitting diode. The control end of the second transistor T2 is electrically connected to the second end of the first transistor T1. The first end of the second transistor T2 receives a power source Vdd. The second end of the second transistor T2 is electrically connected to the first end of the light emitting diode. In the present embodiment, when the gate signal Gate is at an enabling level, the source signal Source will be inputted to the capacitor C via the first transistor T1. When the capacitor C is charged to a voltage level capable of turning on the second transistor T2, the power source Vdd will provide a voltage or a current to drive the light emitting diode. In embodiment, the capacitor C may be charged, such that the light emitting diode can be continuously driven. Therefore, the light emitting diode may be driven by a small magnitude of the drive current. Similarly, the coupling direction of the light emitting diode is not subject to any specific restrictions either. As indicated in FIG. 3A, the anode end P of the first LED group is electrically connected to the second end of the second transistor T2; the cathode end N of the first LED group receives a drive signal Vss. As indicated in FIG. 3B, the cathode end N of the first LED group is electrically connected to the second end of the second transistor T2, the anode end P of the first LED group receives a drive signal Vss. The power source Vdd can be realized by a voltage source or a current source. The power source Vdd may be realized by a DC voltage source or an AC voltage source. The power source Vdd may also be realized by a DC current source or an AC current source. The AC voltage level may be formed by a DC voltage level plus a small magnitude of AC voltage signal. The AC current level may be formed by a DC current level plus a small magnitude of AC current signal.

Similarly, the frame time may include a first cycle and a second cycle. Since the level of the source signal is higher than the level of the drive signal in the first cycle, the LED whose anode end P is electrically connected to the second end of the first transistor T1 (that is, the LED electrically connected according to the coupling direction of FIG. 3A) is turned on, and the LED whose cathode end N is electrically connected to the second end of the first transistor T1 (that is, the LED electrically connected according to the coupling direction of FIG. 3B) is not turned on. Since the level of the source signal is lower than the level of the drive signal in the second cycle, the LED whose anode end P is electrically connected to the second end of the first transistor T1 (that is, the LED electrically connected according to the coupling direction of FIG. 3A) is not turned on, and the LED whose cathode end N is electrically connected to the second end of the first transistor T1 (that is, the LED electrically connected according to the coupling direction of FIG. 3B) is turned on.

Figure 4A:
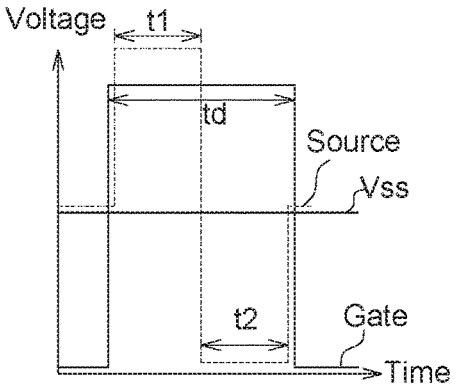
FIG. 4A and FIG. 4B are a schematic diagram of a drive method of a display panel according to an embodiment of the present disclosure.
Figure 4B:
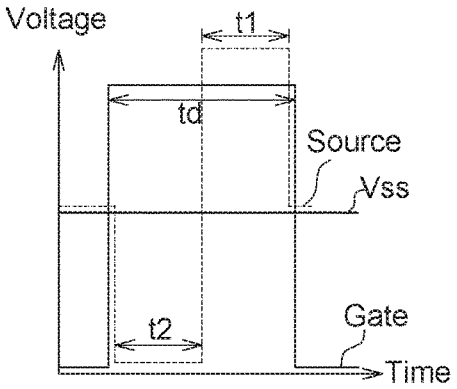

The drive method of the display panel of the present disclosure is elaborated in a number of embodiments below. FIG. 4A and FIG. 4B respectively are a schematic diagram of a drive method of a display panel according to an embodiment of the present disclosure. The drive method of the present disclosure can be used in the display panel of FIGS. 2A-2B or FIGS. 3A-3B. In the present disclosure, a gate signal Gate is provided to a plurality of gate lines G1-Gn. A source signal Source is provided to a plurality of source lines S1-Sm. A drive signal Vss is provided to the second end of each light emitting diode. In a frame time Td of the light emitting diode, the gate signal Gate is at an enabling level to turn on a plurality of first transistors T1, such that each first transistor T1 receives a source signal Source and provides the received source signal Source to the first end of a corresponding light emitting diode. The frame time Td may include a first cycle t1 and a second cycle t2. As indicated in FIG. 4A and FIG. 4B, in the frame time td, the drive signal Vss is at a DC voltage level, and the source signal Source has two different voltage levels. As indicated in FIG. 4A, in the first cycle t1, the source signal Source is at a high level, such that the level of the source signal Source is higher than the level of the drive signal Vss. In the second cycle t2, the source signal Source is at a low level, such that the level of the source signal Source is lower than the level of the drive signal Vss. Or, as indicated in FIG. 4B, firstly in the second cycle t2, the source signal Source is at a low level, such that the level of the source signal Source is lower than the level of the drive signal Vss. Then, in the first cycle t1, the source signal Source is at a high level, such that the level of the source signal Source is higher than the level of the drive signal Vss.

Since the level of the source signal Source is higher than the level of the drive signal Vss in the first cycle t1, the LED whose anode end P is electrically connected to the second end of the first transistor T1 is turned on. Since the level of the source signal Source is lower than the level of the drive signal Vss in the second cycle t2, the LED whose cathode end N is electrically connected to the second end of the first transistor T1 is turned on.

In the present embodiment, the time point at which the gate signal Gate changes to an enabling level (the rising edge of the frame time td) is substantially the same as the initial time from which the source signal Source is higher than the level of the drive signal Vss (the rising edge of the frame time t1). Moreover, the time point at which the gate signal Gate changes to a non-enabling level (the falling edge of the frame time td) is substantially the same as the finish time at which the source signal Source is lower than the level of the drive signal Vss (the rising edge of the frame time t2). For example, when the drive method is used in the display panel 100 of FIG. 2A and FIG. 2B, the gate signal Gate firstly changes to an enabling level, and then provides a source signal Source higher than the drive signal Vss, such that the first transistor T1 is turned on before the light emitting diode is driven. Then, the source signal Source lower than the drive signal Vss is no more provided, and the gate signal Gate changes to a non-enabling level, such that the light emitting diode and the first transistor T1 are turned off in sequence. On the other hand, when the drive method is used in the display panel 100 of FIG. 3A and FIG. 3B, the gate signal Gate changes to a non-enabling level first, and then the source signal Source lower than the drive signal Vss is no more provided, such that the first transistor T1 is turned off to maintain the voltage at the control end of the second transistor T2 and the light emitting diode is then turned off.

Figure 5A:
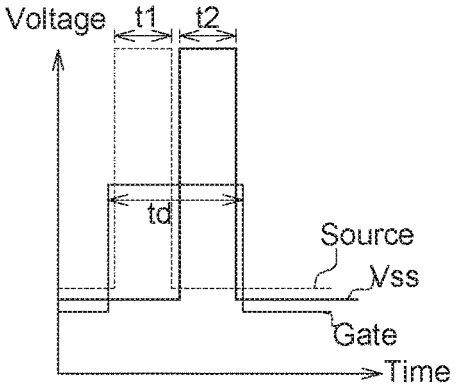
FIG. 5A and FIG. 5B are a schematic diagram of a drive method of a display panel according to an embodiment of the present disclosure.
Figure 5B:
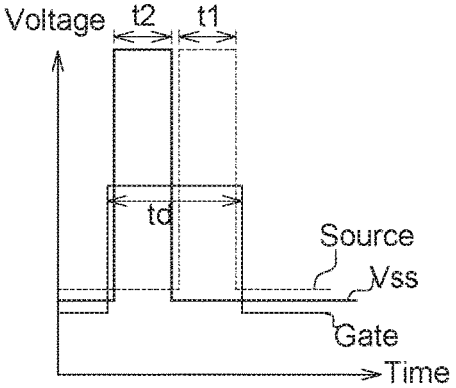

FIG. 5A and FIG. 5B respectively are a schematic diagram of a drive method of a display panel according to an embodiment of the present disclosure. The present embodiment is different from FIG. 4A and FIG. 4B in that: in the present embodiment, in the frame time td, the source signal Source and the drive signal Vss both have two different voltage levels. As indicated in FIG. 5A, in the first cycle t1, the drive signal Vss is at a low level and the source signal Source is at a high level, such that the level of the source signal Source is higher than the level of the drive signal Vss. In the second cycle t2, the drive signal Vss is at a high level and the source signal Source is at a low level, such that the level of the source signal Source is lower than the level of the drive signal Vss. Or, as indicated in FIG. 5B, firstly in the second cycle t2, the drive signal Vss is at a high level and the source signal Source is at a low level latter, such that the source signal Source is lower than the level of the drive signal Vss. Then, in the first cycle t1, the drive signal Vss is at a low level and the source signal Source is at a high level, such that the source signal Source is higher than the level of the drive signal Vss. Therefore, in the first cycle t1, the LED whose anode end P is electrically connected to the second end of the first transistor T1 is turned on. In the second cycle t2, the LED whose cathode end N is electrically connected to the second end of the first transistor T1 is turned on.

Figure 6A:
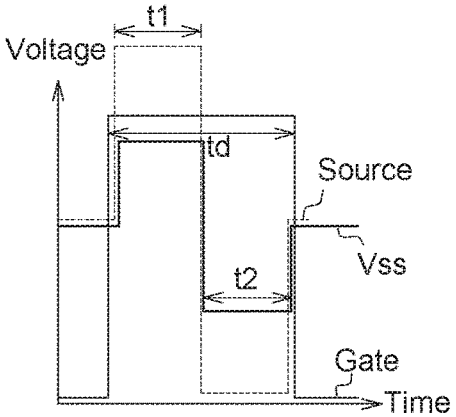
FIG. 6A and FIG. 6B are a schematic diagram of a drive method of a display panel according to an embodiment of the present disclosure.
Figure 6B:
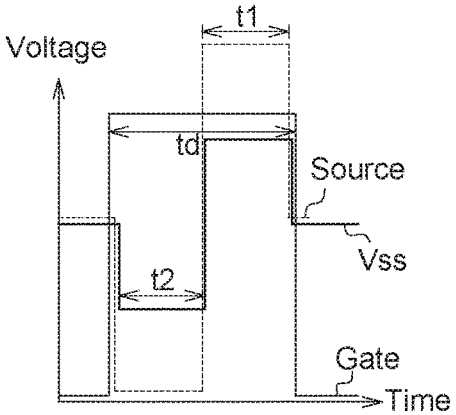

FIG. 6A and FIG. 6B respectively are a schematic diagram of a drive method of a display panel according to an embodiment of the present disclosure. The present embodiment is different from FIG. 4A and FIG. 4B in that: in the present embodiment, in the frame time td, the source signal Source and the drive signal Vss both have two different voltage levels. As indicated in FIG. 6A, in the first cycle t1, the drive signal Vss and the source signal Source both are at a high level, but the level of the source signal Source is higher than the level of the drive signal Vss. In the second cycle t2, the drive signal Vss and the source signal Source both are at a low level, but the level of the source signal Source is lower than the level of the drive signal Vss. Or, as indicated in FIG. 5B, in the second cycle t2, the source signal Source and the drive signal Vss both are at a low level, and the source signal Source is lower than the level of the drive signal Vss. In the first cycle t1, the drive signal Vss and the source signal Source both are at a high level, and the source signal Source is higher than the level of the drive signal Vss. Therefore, in the first cycle t1, the LED whose anode end P is electrically connected to the second end of the first transistor T1 is turned on. In the second cycle t2, the LED whose cathode end N is electrically connected to the second end of the first transistor T1 is turned on.

Figure 7A:
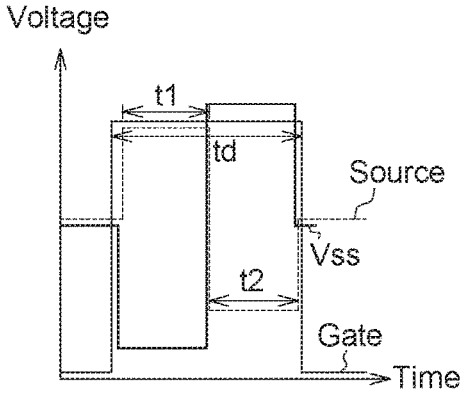
FIG. 7A and FIG. 7B are a schematic diagram of a drive method of a display panel according to an embodiment of the present disclosure.
Figure 7B:
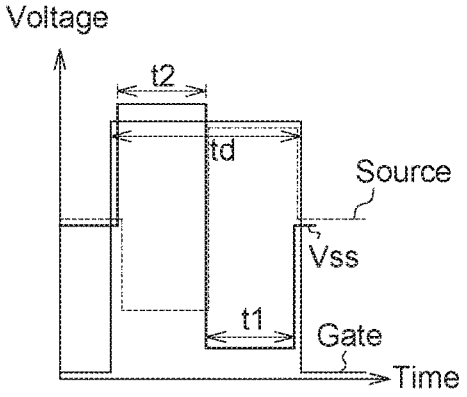

FIG. 7A and FIG. 7B respectively are a schematic diagram of a drive method of a display panel according to an embodiment of the present disclosure. In the present embodiment, in the frame time td, the source signal Source and the drive signal Vss both have two different voltage levels. The present embodiment is different from FIG. 5A and FIG. 5B in that: in the present embodiment, the level difference between the drive signal Vss and the source signal Source is larger than the level difference between the drive signal Vss and the source signal Source of FIG. 5A and FIG. 5B. Therefore, in the present embodiment, the same or a higher luminous intensity of the light emitting diode LED still can be achieved using a lower voltage level of the drive signal Vss or the source signal Source.

Figure 8A:
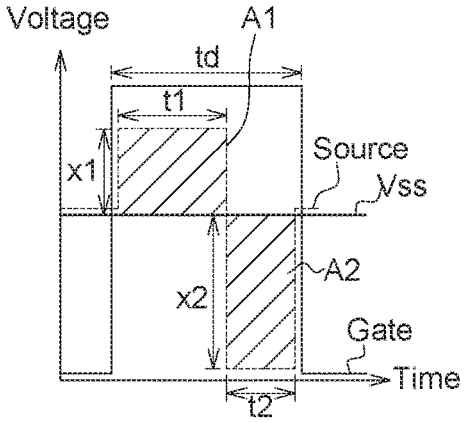
FIG. 8A and FIG. 8B are a schematic diagram of a drive method of a display panel according to an embodiment of the present disclosure.
Figure 8B:
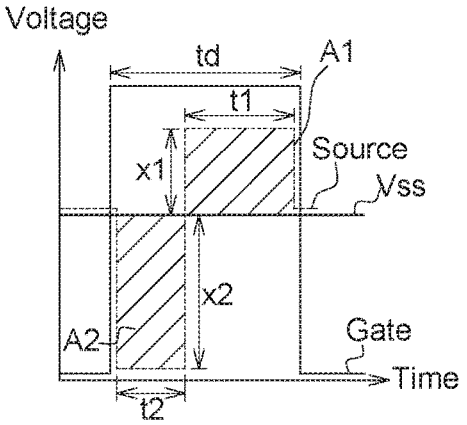

FIG. 8A and FIG. 8B are a schematic diagram of a drive method of a display panel according to an embodiment of the present disclosure. The present embodiment is different from FIG. 4A and FIG. 4B in that: the period of the first cycle t1 is different from the period of the second cycle t2. In the present embodiment, the period of the first cycle t1 is larger than the period of the second cycle t2. Since the period of the first cycle t1 is larger than the period of the second cycle t2, that is, the conducting time of the light emitting diode LED is longer in the first cycle t1, the level difference X1 between the source signal Source and the drive signal Vss in the first cycle t1 is smaller than the level difference X1 between the source signal Source and the drive signal Vss in the second cycle t2.

In an embodiment, the area A1 obtained by multiplying the period of the first cycle t1 with the level difference X1 between the source signal Source and the drive signal Vss is equivalent to the area A2 obtained by multiplying the period of the second cycle t2 with the level difference X1 between the source signal Source and the drive signal Vss. That is, the luminous intensity of the light emitting diode turned on in the first cycle t1 is equivalent to the luminous intensity of the light emitting diode turned on in the second cycle t1. Therefore, in another embodiment, the period of the first cycle t1 may be adjusted to be smaller than the period of the second cycle t2, and the level difference between the source signal Source and the drive signal Vss in the first cycle t1 may be larger than the level difference between the source signal Source and the drive signal Vss in the second cycle t2. Similarly, when the period of the first cycle t1 is equivalent to the period of the second cycle t2, the level difference between the source signal Source and the drive signal Vss in the first cycle t1 is equivalent to the level difference between the source signal Source and the drive signal Vss in the second cycle t2.

Figure 9A:
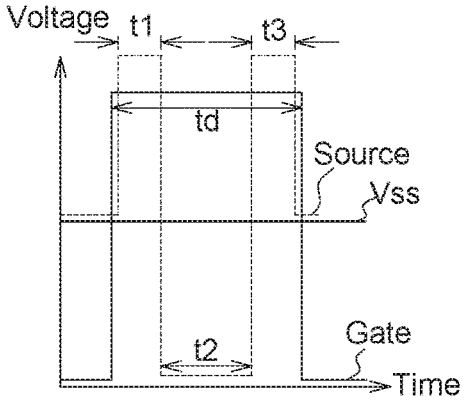
FIG. 9A and FIG. 9B are a schematic diagram of a drive method of a display panel according to an embodiment of the present disclosure.
Figure 9B:
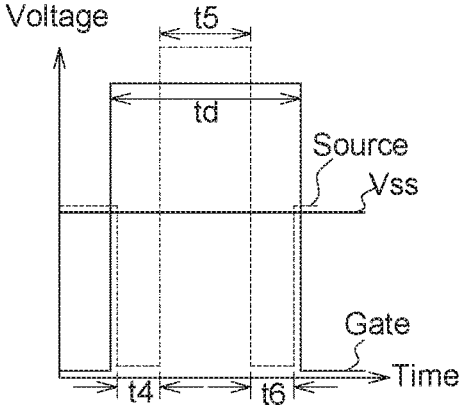

In the present disclosure, the frame time td may include more cycles. FIG. 9A and FIG. 9B are a schematic diagram of a drive method of a display panel according to an embodiment of the present disclosure. In the present embodiment, frame time td may include a first cycle t1, a second cycle t2 and a third cycle t3. As indicated in FIG. 9A and FIG. 9B, in the frame time td, the drive signal Vss is at a DC voltage level, and the source signal Source has two different voltage levels. As indicated in FIG. 9A, in the first cycle t1, the source signal Source is at a high level, such that the level of the source signal Source is higher than the level of the drive signal Vss. In the second cycle t2, the source signal Source is at a low level, such that the level of the source signal Source is lower than the level of the drive signal Vss. In the third cycle t3, the source signal Source is at a high level, such that the level of the source signal Source is higher than the level of the drive signal Vss. Therefore, in the first cycle t1, the LED whose anode end P is electrically connected to the second end of the first transistor T1 is turned on. In the second cycle t2, the LED whose cathode end N is electrically connected to the second end of the first transistor T1 is turned on. In the third cycle t3, the LED whose anode end P is electrically connected to the second end of the first transistor T1 is turned on.

In the present embodiment, the level of the source signal Source in the first cycle t1 is equivalent to the level of the source signal Source in the third cycle t3. However, in another embodiment, the level of the source signal Source in the first cycle t1 is different from the level of the source signal Source in the third cycle t3. In an embodiment, the area A1 obtained by multiplying the period of the first cycle t1 with the level difference X1 between the source signal Source and the drive signal Vss plus the area A3 obtained by multiplying the period of the third cycle t3 with the level difference X3 between the source signal Source and the drive signal Vss is equivalent to the area A2 obtained by multiplying the period of the second cycle t2 with the level difference X1 between the source signal Source and the drive signal Vss. That is, the luminous intensity of the light emitting diode turned on in the first cycle t1 and the third cycle t3 (the LED electrically connected using FIG. 2A or FIG. 3A) is equivalent to the luminous intensity of the light emitting diode turned on in the second cycle t1 (the LED electrically connected using FIG. 2B or FIG. 3B).

Similarly, in FIG. 9B, in the fourth cycle t4, the source signal Source is at a low level, such that the level of the source signal Source is lower than the level of the drive signal Vss. In the fifth cycle t5, the source signal Source is at a high level, such that the level of the source signal Source is higher than the level of the drive signal Vss. In the sixth cycle t6, the source signal Source is at a low level, such that the level of the source signal Source is lower than the level of the drive signal Vss. Therefore, in the fourth cycle t4, the LED whose cathode end N is electrically connected to the second end of the first transistor T1 is turned on. In the fifth cycle t5, the LED whose anode end P is electrically connected to the second end of the first transistor T1 is turned on. In the sixth cycle t6, the LED whose cathode end N is electrically connected to the second end of the first transistor T1 is turned on.

However, the present disclosure is not limited thereto. In the present disclosure, the level difference between the drive signal Vss and the source signal Source may further be adjusted according to the properties of light emitting diodes. For example, if the light emitting diodes are more tolerable with the forward bias, then the level difference between the drive signal Vss and the source signal Source may be adjusted such that the level difference between the source signal Source and the drive signal Vss in the first cycle (when the source signal Source is higher than the level of the drive signal Vss) is larger than the level difference between the drive signal Vss and the source signal Source in the second cycle (when the source signal Source is lower than the level of the drive signal Vss). On the other hand, if the light emitting diodes are more tolerable with the reverse bias, then the level difference between the drive signal Vss and the source signal Source may be adjusted, such that the level difference between the source signal Source and the drive signal Vss in the first cycle (when the source signal Source is higher than the level of the drive signal Vss) is smaller than the level difference between the drive signal Vss and the source signal Source in the second cycle (when the source signal Source is lower than the level of the drive signal Vss).

It should be noted that FIGS. 4A-9B of the present disclosure are for explanatory purpose only. The present disclosure is not limited thereto. Depending on the actual needs, the gate signal Gate, the source signal Source, and the drive signal Vss or the time points at which the gate signal Gate, the source signal Source, and the drive signal Vss change may be adjusted. Or, the gate signal Gate, the source signal Source, and the drive signal Vss can have more voltages levels in a frame time.

A display panel and a drive method thereof are disclosed in above embodiments. The display panel includes a plurality of gate lines, a plurality of source lines, a plurality of first transistors and a plurality of light emitting diodes. The control end of each first transistor is electrically connected to one of the gate lines and receives a gate signal. The first end of each first transistor is electrically connected to one of the source lines and receives a source signal. The first end of each LED is electrically connected to the second end of a corresponding first transistor. The second end of each LED receives a drive signal. A frame time at least includes a first cycle and a second cycle. In the first cycle of the frame time, the level of the source signal is higher than the level of the drive signal. In the second cycle of the frame time, the level of the source signal is lower than the level of the drive signal.

According to the display panel of the present disclosure, in a first cycle of the frame time, the level of the source signal is higher than the level of the drive signal, such that the LED whose anode end P is electrically connected to the second end of the first transistor T1 is turned on. In a second cycle of the frame time, the level of the source signal is lower than the level of the drive signal such that the LED whose cathode end N is electrically connected to the second end of the first transistor T1 is turned on. Thus, the drive method of the present disclosure can conduct the LED electrically connected according to either one of the two coupling directions.

While the disclosure has been described by way of example and in terms of the embodiment(s), it is to be understood that the disclosure is not limited thereto. On the contrary, it is intended to cover various modifications and similar arrangements and procedures, and the scope of appended claims therefore should be accorded the broadest interpretation so as to encompass all such modifications and similar arrangements and procedures.

What is claimed is:

1. A display panel, comprising:

a plurality of gate lines;

a plurality of source lines;

a plurality of first transistors, wherein a control end of each of the first transistors is electrically connected to one of the gate lines and receives a gate signal, and a first end of each of the first transistors is electrically connected to one of the source lines and receives a source signal; and a plurality of light emitting diodes (LEDs), wherein a first end of each of the LEDs is electrically connected to a second end of one of the corresponding first transistors, and a second end of each of the LEDs receives a drive signal;

wherein a frame time of the light emitting diodes comprises at least a first cycle and a second cycle;

in the first cycle of the frame time, a level of the source signal is higher than a level of the drive signal; in the second cycle of the frame time, the level of the source signal is lower than the level of the drive signal; and when a period of the first cycle is equivalent to a period of the second cycle, a level difference between the source signal and the drive signal in the first cycle is equivalent to a level difference between the source signal and the drive signal in the second cycle.

2. The display panel according to claim 1, wherein the LEDs comprise a first LED group and a second LED group, a first end of each of the first LED group is an anode end, a second end of the first LED group is a cathode end, a first end of the second LED group is a cathode end, and a second end of the second LED group is an anode end.

3. The display panel according to claim 1, wherein the drive signal is a direct current (DC) voltage signal, an alternating current (AC) voltage signal, a DC current signal or an AC current signal.

4. The display panel according to claim 1, wherein the level of the drive signal in the first cycle is different from the level of the drive signal in the second cycle.

5. The display panel according to claim 1, wherein the level of the source signal in the first cycle is different from the level of the source signal in the second cycle.

6. The display panel according to claim 1, wherein when a period of the first cycle is smaller than a period of the second cycle, a level difference between the source signal and the drive signal in the first cycle is larger than a level difference between the source signal and the drive signal in the second cycle.

7. The display panel according to claim 1, wherein the frame time of the light emitting diodes further comprises a third cycle, the level of the source signal is higher than the level of the drive signal in the third cycle.

8. The display panel according to claim 1, wherein the frame time of the light emitting diodes further comprises a third cycle the level of the source signal is lower than the level of the drive signal in the third cycle.

9. A drive method of a display panel, comprising:

providing a gate signal to a plurality of gate lines;

providing a source signal to a plurality of source lines; and providing a drive signal to a plurality of second ends of a plurality of light emitting diodes (LEDs);

wherein a frame time of the light emitting diodes comprises at least a first cycle and a second cycle;

in the first cycle of the frame time, a level of the source signal is higher than a level of the drive signal; in the second cycle of the frame time, the level of the source signal is lower than the level of the drive signal; and when a period of the first cycle is equivalent to a period of the second cycle, a level difference between the source signal and the drive signal in the first cycle is equivalent to a level difference between the source signal and the drive signal in the second cycle.

10. The drive method according to claim 9, wherein the light emitting diodes comprise a first LED group and a second LED group, a first end of the first LED group is an anode end, a second end of the first LED group is a cathode end, a first end of the second LED group is a cathode end, and a second end of the second LED group is an anode end.

11. The drive method according to claim 9, wherein the drive signal is a DC voltage signal, a DC current signal, an AC voltage signal or an AC current signal.

12. The drive method according to claim 9, wherein the level of the drive signal in the first cycle is different from the level of the drive signal in the second cycle.

13. The drive method according to claim 9, wherein the level of the source signal in the first cycle is different from the level of the source signal in the second cycle.

14. The drive method according to claim 9, wherein when a period of the first cycle is smaller than a period of the second cycle, a level difference between the source signal and the drive signal in the first cycle is larger than a level difference between the source signal and the drive signal in the second cycle.

15. The drive method according to claim 9, wherein the frame time of the light emitting diodes further comprises a third cycle of the frame time, the level of the source signal is higher than the level of the drive signal in the third cycle.

16. The drive method according to claim 9, wherein the frame time of the light emitting diodes further comprises a third cycle of the frame time, the level of the source signal is lower than the level of the drive signal in the third cycle.

17. A display panel, comprising:

a plurality of gate lines;

a plurality of source lines;

a plurality of first transistors, wherein a control end of each of the first transistors is electrically connected to one of the gate lines and receives a gate signal, and a first end of each of the first transistors is electrically connected to one of the source lines and receives a source signal; and a plurality of light emitting diodes (LEDs), wherein a first end of each of the LEDs is electrically connected to a second end of one of the corresponding first transistors, and a second end of each of the LEDs receives a drive signal;

wherein a frame time of the light emitting diodes comprises at least a first cycle and a second cycle;

in the first cycle of the frame time, a level of the source signal is higher than a level of the drive signal; in the second cycle of the frame time, the level of the source signal is lower than the level of the drive signal; and when a period of the first cycle is larger than a period of the second cycle, a level difference between the source signal and the drive signal in the first cycle is smaller than a level difference between the source signal and the drive signal in the second cycle.

18. A drive method of a display panel, comprising:

providing a gate signal to a plurality of gate lines;

providing a source signal to a plurality of source lines; and providing a drive signal to a plurality of second ends of a plurality of light emitting diodes (LEDs);

wherein a frame time of the light emitting diodes comprises at least a first cycle and a second cycle;

in the first cycle of the frame time, a level of the source signal is higher than a level of the drive signal; in the second cycle of the frame time, the level of the source signal is lower than the level of the drive signal; and when a period of the first cycle is larger than a period of the second cycle, a level difference between the source signal and the drive signal in the first cycle is smaller than a level difference between the source signal and the drive signal in the second cycle.

* * * * *